US012134508B2

(12) United States Patent
Sax et al.

(10) Patent No.: US 12,134,508 B2
(45) Date of Patent: Nov. 5, 2024

(54) DEVICE FOR REDUCING CONSUMPTION OF FLAVORING AGENTS FROM BEVERAGES

(71) Applicant: POTIIO GMBH, Zürich (CH)

(72) Inventors: Cédric Sax, Zürich (CH); Samuel Hess, Zürich (CH); Basil Denzler, Winterthur (CH); Elia Schneider, Schaffhausen (CH)

( * ) Notice: Subject to any disclaimer, the term of this patent is extended or adjusted under 35 U.S.C. 154(b) by 124 days.

(21) Appl. No.: 17/803,427

(22) Filed: Jul. 6, 2022

(65) Prior Publication Data

US 2023/0040856 A1 Feb. 9, 2023

Related U.S. Application Data

(63) Continuation-in-part of application No. PCT/EP2021/050738, filed on Jan. 14, 2021.

(60) Provisional application No. 62/995,164, filed on Jan. 16, 2020.

(30) Foreign Application Priority Data

Jul. 12, 2021 (CH) ..... 70038/2021

(51) Int. Cl.
*B65D 81/32* (2006.01)

(52) U.S. Cl.
CPC ..... *B65D 81/3216* (2013.01)

(58) Field of Classification Search
CPC . B65D 81/3216; B65D 81/3222; B65D 81/32
USPC ..... 206/219, 221
See application file for complete search history.

(56) References Cited

U.S. PATENT DOCUMENTS

2007/0075081 A1 4/2007 Stokes
2009/0206084 A1* 8/2009 Woolf ..... B65D 25/08 426/597
2011/0259769 A1* 10/2011 Salinas ..... B65D 51/2864 206/219
2014/0272019 A1* 9/2014 Schuh ..... A47J 31/401 426/115
2014/0288495 A1* 9/2014 Olmos ..... A23L 2/395 426/89
2015/0090711 A1* 4/2015 Peterson ..... A61J 9/0638 220/4.07
2015/0223632 A1 8/2015 Hall
2020/0130884 A1 4/2020 Le Reverend et al.
(Continued)

*Primary Examiner* — Jacob K Ackun
(74) *Attorney, Agent, or Firm* — Richard Voellmy

(57) ABSTRACT

The disclosure relates to a drinking device that comprises two separate compartments, a first compartment for holding a flavored beverage or a flavoring agent for reconstituting the flavored beverage and a second compartment for holding an unflavored or weakly favored beverage, and a switching mechanism that allows for the sequential consumption of beverage from the first and the second compartment such that a subject ingests, in the course of each drinking event, first a volume of the flavored beverage and thereafter a volume of the unflavored or weakly favored beverage. Drinking from the device conveys to the subject a sensory experience that is similar to that produced by a typical uniformly flavored beverage even though it only consumed a fraction of the amount of flavoring agent that it would have consumed from drinking an equivalent volume of the uniformly flavored beverage.

5 Claims, 11 Drawing Sheets

(56) References Cited

U.S. PATENT DOCUMENTS

2021/0139222 A1* 5/2021 Gisholt ..... B65D 5/38

* cited by examiner

DEVICE FOR REDUCING CONSUMPTION OF FLAVORING AGENTS FROM BEVERAGES

TECHNICAL FIELD

The present disclosure relates to mechanical devices that deliver flavored and unflavored or less flavored beverages in a sequence to reduce the cumulative amount of flavoring agent consumed without loss of flavor sensation.

BACKGROUND

The consumption of flavored drinks is a general desire and has created a huge market of flavored bottled beverages to satisfy the demand of the customers. To maximize flavor perception, generous amounts of additives including sugars, sweeteners, acids, bittering agents or the like are added to the beverages, forming homogeneous solutions. In the case of sugars, which are mostly added in the form of saccharose or fructose, more than 10 wt. % are present in the most popular sweetened beverages. Such beverages are highly desired because their consumption results in an immediate reward to the body. Sugar sensation and calorie intake are closely coupled in the human brain. The elevated blood sugar level resulting from the consumption of such beverages induces an increased insulin level that in turn reduces the blood sugar level. The blood sugar level after consumption of a highly sweetened beverage can be lower than the initial level which then generates a craving for more sugar (M. E. Daly, C. Vale, M. Walker, A. Littlefield, K. Alberti, J. Mathers, Am J Clin Nutr, 1998, 67, 1186). This vicious circle combined with the worldwide abundance of such sweetened beverages leads to a daily sugar intake that is typically twice that recommended by the World Health Organization (Guideline: Sugars intake for adults and children, Geneva: World Health Organization, 2015; Statistische Erhebungen und Schatzungen Ober Landwirtschaft und Ernahrung—chapter 6: Ernährung, Neuchatel, Switzerland, Swiss Federal Statistical Office, 2017). Such an overconsumption is related to obesity and numerous other diseases such as type 2 diabetes and cardiovascular problems, in particular in the western population (www.who.int/news-room/fact-sheets/detail/obesity-and-overweight, visited November 2019).

With the rising public awareness of these health consequences, the sugars in some beverages have been replaced by artificial sweeteners. Unfortunately, the impact of the use of such additives on the human metabolism remains largely unknown (Y. Kim, J. B. Keogh, P. M. Clifton, Curr Atheroscler Rep, 2019, 21, 49). Furthermore, it has been frequently reported that consumers feel an odd after-taste when drinking such so-called "light products". In addition, consumers generally have become concerned about artificial additives and prefer beverages containing only natural products.

Simply lowering the sugar content of beverages does not appear to be an acceptable solution. Even though a reduced sugar content in a beverage inevitably leads to a lower intake of calories (on a volume basis), the taste of the beverage is drastically changed, and the lack of sweetness lowers consumer satisfaction.

In a novel approach, a mineral carrier is loaded with a flavoring agent, e.g., as a sugar or a salt. When delivered bound to the carrier, the flavoring agent is believed to stay longer at the taste receptors on the tongue than in its free form. This technology may make it possible to reduce the amount of flavoring agent in a beverage without affecting sensation (www.douxmatok.com/technology-platform, visited November 2019). However, this approach is only intended for use in foods, and no product that employs this technology has entered the market, yet. Furthermore, it remains to be determined whether or not the mineral carrier negatively affects digestion.

Alternative approaches to reducing consumption of flavoring agents, in particular sugars, from flavored beverages without also diminishing their acceptance are clearly needed. The present disclosure relates to a novel solution that achieves this goal.

SUMMARY OF THE INVENTION

The present disclosure relates to a novel concept for reducing consumption of flavoring agents (such as sugars) from flavored beverages and to devices that implement this concept. The novel concept is based on the observation that a taste sensation induced on the tongue, the palate and the early parts of the digestive system by the ingestion of a flavored beverage does not disappear immediately after consumption but stays on for a certain period of time. This phenomenon is referred to as the "retention effect". During the latter period of time, a subject will not be able to tell the difference between drinking a typical, uniformly flavored beverage and drinking an unflavored or weakly flavored beverage. Hence, consumption of flavoring agent from a flavored beverage could be reduced, without loss of taste sensation, if the subject engaged in one or more discreet drinking events each comprising the sequential consumption of a small volume of flavored beverage and a similar or larger volume of unflavored or weakly flavored beverage instead of drinking a uniformly flavored beverage.

Therefore, the present disclosure relates to a device for the controlled sequential release of a flavored beverage and a less flavored or unflavored beverage. The device comprises a drinking vessel typically comprising a mouthpiece for drinking from the drinking vessel, a first compartment within the drinking vessel, the first compartment holding the flavored beverage (or a flavoring agent for reconstitution of the flavored beverage), a second separate compartment within the drinking vessel, the second compartment holding the less flavored or unflavored beverage, and a mechanism that releases first a defined volume of the flavored beverage and thereafter a volume of the less flavored or unflavored beverage when a subject drinks from the drinking vessel. In a more particular embodiment, the latter mechanism can also limit the volume of the less flavored or unflavored beverage that the subject can consume during a single drinking event, i.e., prevents consumption of the beverage beyond a preset maximal volume.

The mouthpiece can have any suitable shape or form, including that of a drinking tube or straw. The drinking vessel may generally be made of rigid material, although it may also contain one or more zones that are made of flexible material for pressure compensation. The mechanism that releases to the subject first a defined volume of the flavored beverage and thereafter a volume of the less flavored or unflavored beverage will typically include the feature of reverting to its original setting after a certain volume of the less flavored or unflavored beverage has been consumed, i.e., has been withdrawn from the device. The original setting is the setting that enables consumption of flavored beverage. The amount of flavoring agent in the flavored beverage can be similar on a weight (wt.) basis to that present in a typical marketed beverage (on average 9 g/100 mL) or can exceed that amount. In the less flavored or unflavored beverage, flavoring agent can be absent or present in an amount that is less than that present on a wt. basis in a typical marketed beverage. Preferably, it will be less than 50 wt. % of that amount and, more preferably, less than 5 wt. % of that amount. The device can be configured for a single drinking event or it (i.e., its mechanism) can support (or effect) the sequential release of flavored beverage and less flavored or unflavored beverage during multiple drinking events. The volume of the flavored beverage that is released during a single drinking event can be between 0.1 and 15 mL, more preferably, between 1 and 10 mL and, most preferably, between 2 and 6 mL. In embodiments of the device in which the control mechanism limits the consumption of the less flavored or unflavored beverage that the subject can consume during a single drinking event, the maximal volume can be limited to 3-50 times the volume of the flavored beverage that is released during the same drinking event, more preferably to 6-20 times the volume of the flavored beverage that is released during the same drinking event and, most preferably, to 9-15 times the volume of the flavored beverage that is released during the same drinking event. It is noted that, at the time of distribution, devices of this disclosure may not contain any beverage or may be pre-filled with flavored beverage and/or less flavored or unflavored beverage.

The present disclosure also encompasses a device for enabling the controlled sequential release of a flavored beverage and a less flavored or unflavored beverage from a drinking vessel that comprises two separate parts. The first part is a closable drinking vessel having a threaded neck or other closable neck holding the less flavored or unflavored beverage. The second part is an assembly comprising a screw cap or other cap adapted for the closure of the drinking vessel, a drinking tube that passes through the cap, the portion of the drinking tube protruding to the outside of the cap serving as a mouthpiece or having been fitted with a mouthpiece and, mounted on the portion of the drinking tube protruding to the inside of the cap (the drinking tube fluidly connecting with (i.e., being immersed in) the less flavored or unflavored beverage in the fully assembled device), a unit comprising a container holding the flavored beverage and a fluid control mechanism. After the assembly has been joined with the drinking vessel, the latter mechanism mediates the release, through the mouthpiece, first of a defined volume of the flavored beverage and thereafter a volume of the less flavored or unflavored beverage when a subject is drinking from the mouthpiece of the fully assembled device. Optionally, the mechanism also limits the volume of the less flavored or unflavored beverage that the subject can consume during a single drinking event, i.e., prevents consumption of the beverage beyond a preset maximal volume. In another embodiment, the second part is an assembly comprising a screw cap adapted for the closure of the drinking vessel and a drinking tube impregnated on its interior surface with a flavoring agent or comprising a compartment that is integrated, i.e., is fluidly connected, with the drinking tube and is holding the flavoring agent. The drinking tube passes through the screw cap, the portion of the drinking tube protruding to the outside of the screw cap serving as a mouthpiece or having been fitted with a mouthpiece and the portion of the drinking tube protruding to the inside being capable of fluidly connecting with the less flavored or unflavored beverage in the fully assembled device. A subject drinking from the assembled device will first ingest a flavored beverage resulting from the dissolution of the flavoring agent present in the drinking tube (or the compartment integrated in the drinking tube that holds the flavoring agent) and thereafter the less flavored or unflavored beverage.

In further embodiments, the device for enabling the controlled sequential release of a flavored beverage and a less flavored or unflavored beverage from a drinking vessel comprises two parts that are not assembled but are used in concert. The first part of such a two-part device comprises a drinking vessel holding the less flavored or unflavored beverage. The second part can comprise a drinking tube impregnated on its interior surface with a flavoring agent. In another particular embodiment, the second part can comprise a compartment that is integrated, i.e., is fluidly connected, with a drinking tube and is holding the flavoring agent, whereby, in the course of a drinking event, the less flavored or unflavored beverage passing through the drinking tube dissolves the flavoring agent. In a further particular embodiment, the second part can comprise a drinking tube containing an integrated unit comprising a container holding the flavored beverage and a mechanism that, when the drinking tube is in communication with the beverage in the drinking vessel, releases through the drinking tube first a defined volume of the flavored beverage and thereafter a volume of the less flavored or unflavored beverage when a subject is drinking from the drinking tube.

In a particular embodiment, the first compartment of the device is a first container that is to hold a flavored beverage, the first container having a first neck portion comprising a straight conduit that fluidly connects the interior space of the container with an orifice and a first perforated indentation in the wall or the bottom, which indentation is sealedly covered at its base by a flexible gas- and liquid-impermeable membrane. The second compartment is a second container that is to hold a less flavored beverage or an unflavored beverage, the second container having a second neck portion comprising one or more conduits that helically wind through the second neck portion and fluidly connect the interior space of the second container with one or more orifices and a second perforated indentation in the wall or the bottom, which indentation is sealedly covered at its base by a flexible gas- and liquid-impermeable membrane: The term "sealedly covered" is meant to indicate that the perimeter of the membrane is connected to the base of the indentation in a gas- and liquid-impermeable fashion. The first container is contained in the second container and the first neck portion is sealedly inserted into the second neck portion, whereby the first and second neck portions are forming a mouthpiece from which a subject can drink. The term "sealedly inserted" is meant to indicate that the neck portions are joined in a gas- and liquid-tight fashion. In more particular embodiments, the device is provided as two unassembled parts, e.g., a reusable second container and a first container that may or not be pre-filled with flavored beverage. In another more particular embodiment, a kit comprising a first container is provided that allows for the use of a commercial drinking bottle as the second container.

In a further particular embodiment of the device, the first compartment is a first container having a stiff upper portion and a flexible lower portion and the second compartment is a rigid second container having a doughnut-shaped horizontal cross-section defining an inner space into which the first container is inserted, a neck portion comprising one or more outer conduits and an inner conduit, and a valve for pressure regulation (e.g., an umbrella valve) inserted in the wall of the container, wherein the outer conduits wind helically through the neck portion and fluidly connect the interior space of the second container with one or more orifices at the exposed end of the neck portion and wherein the inner conduit is straight and fluidly connects the interior space of the first container with a further orifice at the exposed end of the neck portion. The first container is to hold a flavored beverage and the second container a less flavored or unflavored beverage.

DETAILED DESCRIPTION

Unless otherwise defined below or elsewhere in the present specification, all terms shall have their ordinary meaning in the relevant art.

The terms "flavor", "flavoring agent", "flavored solution", "flavored liquid", "flavor particles", and "flavor powder" denote compounds/molecules that are detected by receptors on the human tongue and to aqueous solutions or suspensions thereof. The compounds may be dissolved or suspended directly in the aqueous solution or after attachment to an organic or inorganic carrier. The terms typically relate to sugars of different types such as sucrose, glucose, fructose, maltose, lactose, high fructose corn syrup, high maltose corn syrup, and combinations thereof. The latter flavoring agents are also referred to as "flavor enhancers". However, they are also meant to encompass artificial sweeteners including but not restricted to saccharin, acesulfame, aspartame, neotame, sucralose and *stevia*, acids, bittering agents, alcohol or caffeine.

The term "drinking event" relates to the asymmetric unit in a repetitive drinking pattern that is observable when a user drinks out of a drinking device. A "drinking event" as used herein always consist of a first consumption by a subject of a specified volume of a first solution containing a flavoring agent and a second consumption of a second solution that lacks the flavoring agent or contains it at a lower concentration than the first solution, whereby first and second consumption occur in rapid sequence.

The term "retention effect" describes the observation that taste sensations on the human tongue or elsewhere in the oral cavity or early digestive system persist beyond the passage of a flavored solution. This effect is discussed in more detail below.

The terms "fluid", "solution" or "beverage" typically relate to drinkable liquids. However, the terms are also meant to generally encompass compositions that are pourable.

The terms "subject", "consumer" or "user" are used interchangeably and relate to a human person engaging in a drinking event.

Figure 1:
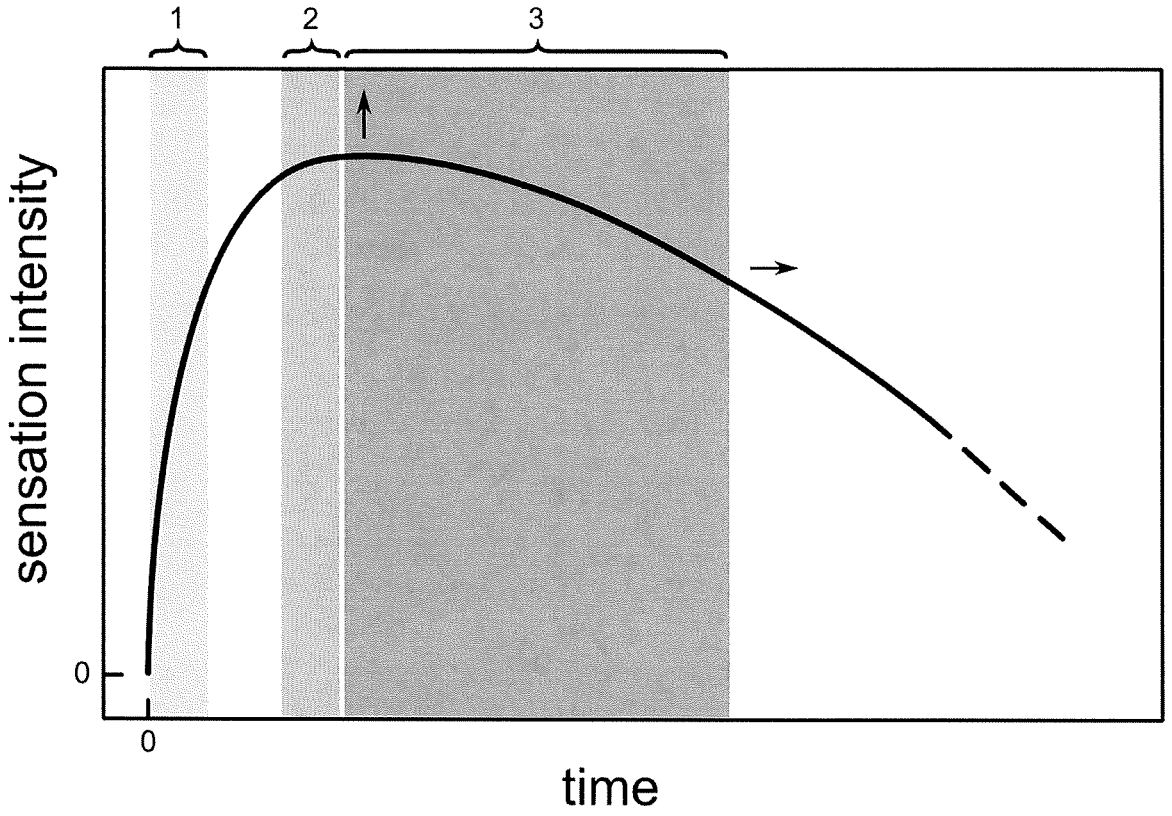
FIG. 1 describes schematically the rise and decay of taste sensation that occurs when a flavoring agent comes in contact with taste receptors on the human tongue. 1: beverage intake; 2: swallowing of beverage; 3: useful retention effect. Arrow pointing upward: maximal taste sensation; arrow pointing sideways: waning retention effect.

The present disclosure relates to a device that reduces the amount of flavoring agent consumed on a per volume basis when compared with the amount of flavoring agent consumed when drinking a conventional flavored beverage without significantly diminishing taste sensation. This reduction is not achieved by an addition of a compound of any kind that makes up for the loss in taste sensation that typically results when the concentration of flavoring agent in a beverage is reduced. Rather, the reduction in the amount of flavoring agent consumed is achieved by modulating the flavoring agent concentration in the beverage as the beverage is consumed in the course of a drinking event. The underlying rationale of this approach is explained in FIG. 1. The gustatory system is based on taste receptor cells that are present in taste buds. Taste buds are comprised in structures called papillae that cover most of the dorsal surface of the tongue. Taste buds are also found in the palate and early parts of the digestive system like the larynx and upper part of the esophagus. Sweet, bitter and umami tastes are detected by G protein-coupled taste receptors. Other tastes, i.e., sour and salty tastes, are sensed by way of ion channels. When flavoring agents from a beverage interact with taste receptors, the receptors are rapidly activated, which results in taste perception by the consumer of the flavored beverage. Detectable activation may occur within a fraction of a second. The taste sensation typically persists well after swallowing. The reasons for this persistence of sensation, referred to as the retention effect, are believed to be severalfold. Flavoring agents may remain in the oral cavity either because they are adsorbed to tissue surfaces or because they are sequestered by the papillae or taste buds. Furthermore, and this is perhaps the predominant reason, desensitization of receptors such as the G protein-coupled taste receptors for sugars is not instantaneous. As has been shown, e.g., by Nelson et al. (G. Nelson, M. A. Hoon, J. Chandrashekar, Y.

Zhang, N. J. P. Ryba, C. S. Zuker, Cell, 2001, 106, 381;), desensitization may take tens of seconds. The novel approach disclosed herein takes advantage of this retention effect to reduce consumption of flavoring agents from flavored beverages.

The following experiments may be performed to demonstrate the operation of the novel approach:

Experiment 1

For part A of the experiment, 8 small beverage portions (SBPs) are prepared (e.g., in 50 mL Eppendorf tubes). Four of those SBPs contain 0.7 wt. % citric acid (added in the form of natural lemon juice), 10 wt. % of sugar (sucrose) and water in a total volume of 35 mL. The other four SBPs contain the same amount of citric acid but only 5 wt. % of sugar in the same total volume.

For part B of the experiment, the SBPs come in the form of associated pairs of solution-containing tubes, a small tube holding 5 mL of solution and a larger tube containing 30 mL of solution. Again, 8 SBPs are prepared. The first 4 SBPs are comprised of a small and a larger tube that both hold solution containing 10 wt. % of sugar and 0.7 wt. % of citric acid. In the remaining 4 SBPs, the small tube holds solution containing 35 wt. % of sugar and 0.7 wt. % of citric acid, and the large tube a solution of 0.7 wt. % citric acid.

In both parts of the experiment 20 test persons drink the 8 SBPs in a random sequence and are asked to rate the sweetness on a scale of 1 (not or only marginally sweet) to 4 (very sweet). For part B, the test persons are required to empty the two tubes of each set in a rapid sequence, each time drinking the contents of the small tube first.

In part A of the experiment, it is expected that the test persons are able to differentiate very well between the different sugar concentrations, scoring the less sweet SBPs considerably lower than the sweeter SBPs. In part B of the experiment, the test persons are not able to distinguish the two kinds of SBPs. Both, the SBPs containing in total 5 wt % sugar (sugar only in the small tube) and the SBPs containing 10 wt. % sugar (sugar in both tubes) obtain similar elevated scores. Thus, the experiment is expected to confirm that the retention effect can be exploited to reduce the amount of sugar consumed on a per volume basis when compared with the amount of sugar consumed when drinking a conventional sugared beverage, and this without significantly compromising taste sensation.

Experiment 2

Figure 2:
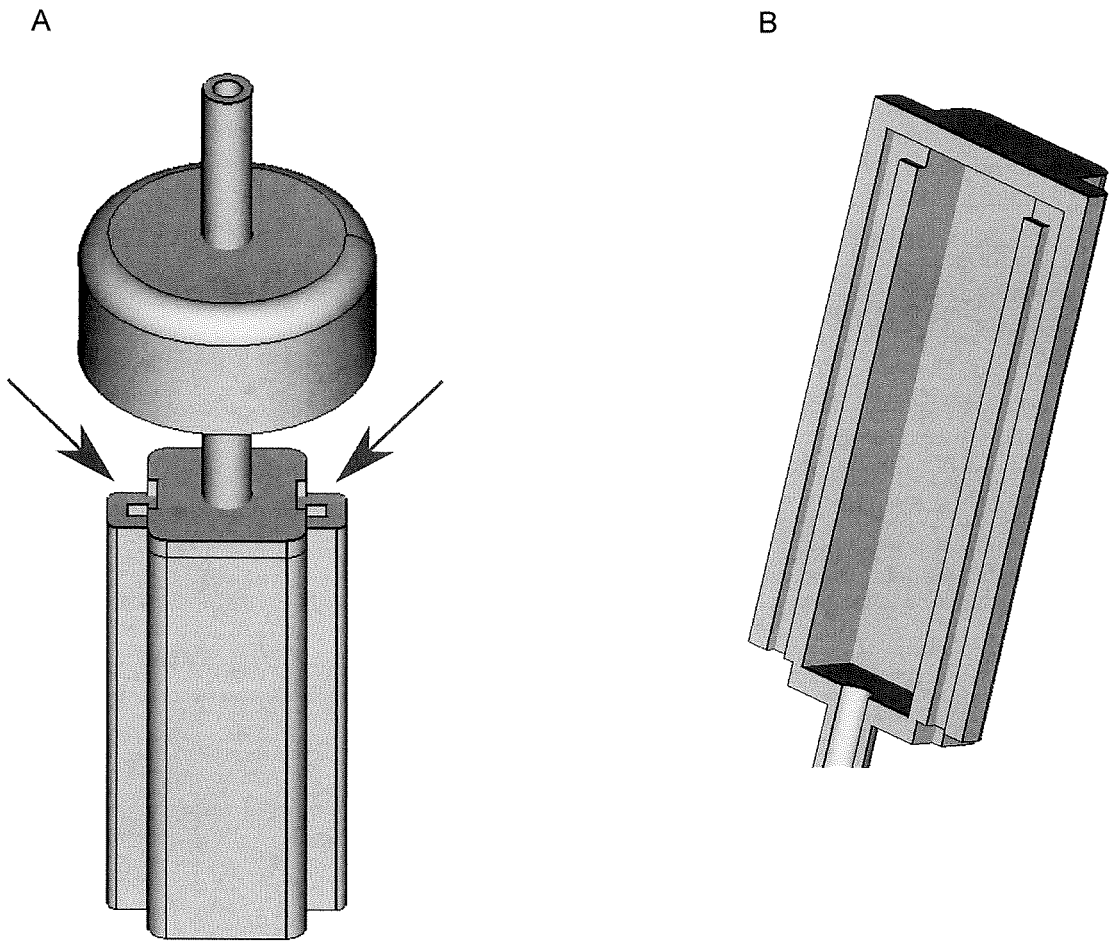
FIG. 2 shows a side view and a section relating to a device used for proof-of-principle experiments.
Figure 3:
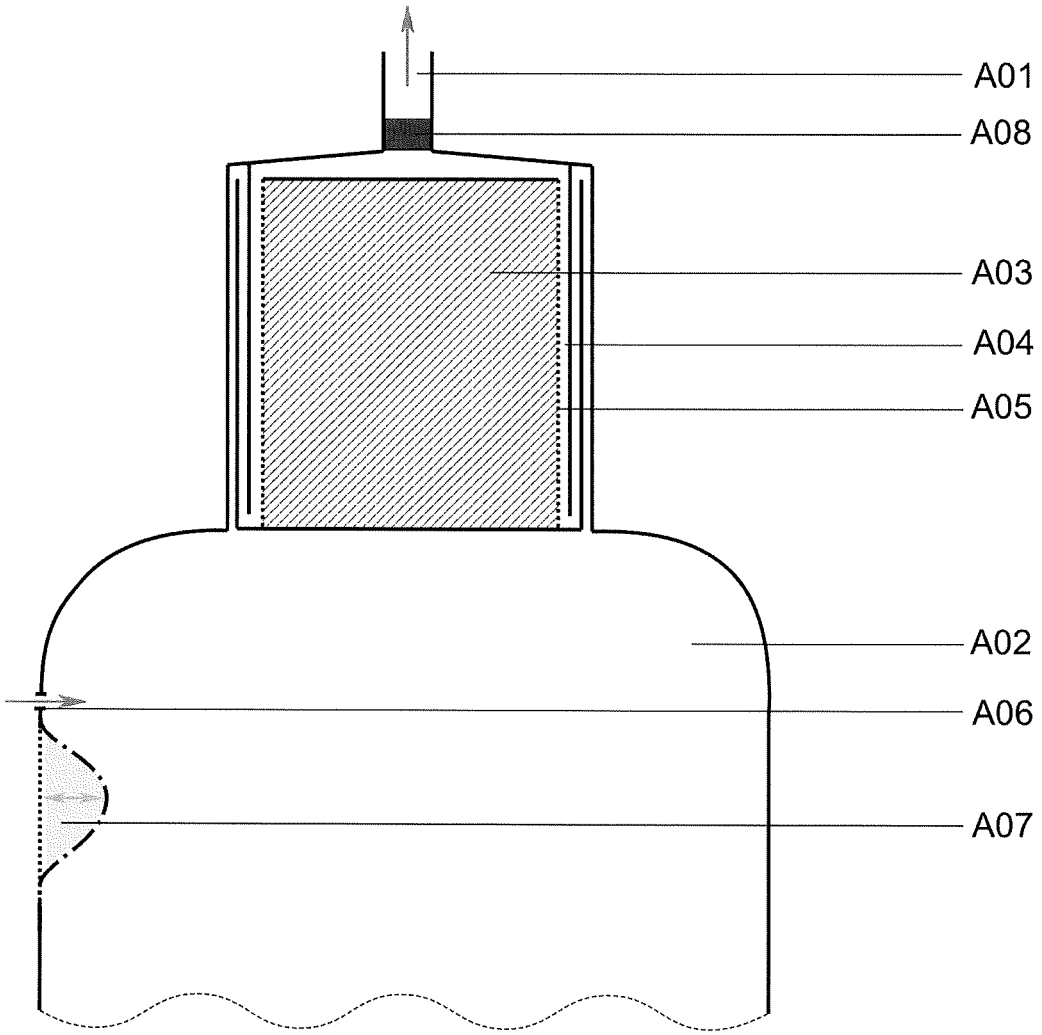
FIG. 3 schematically depicts the device of Example A.
Figure 4:
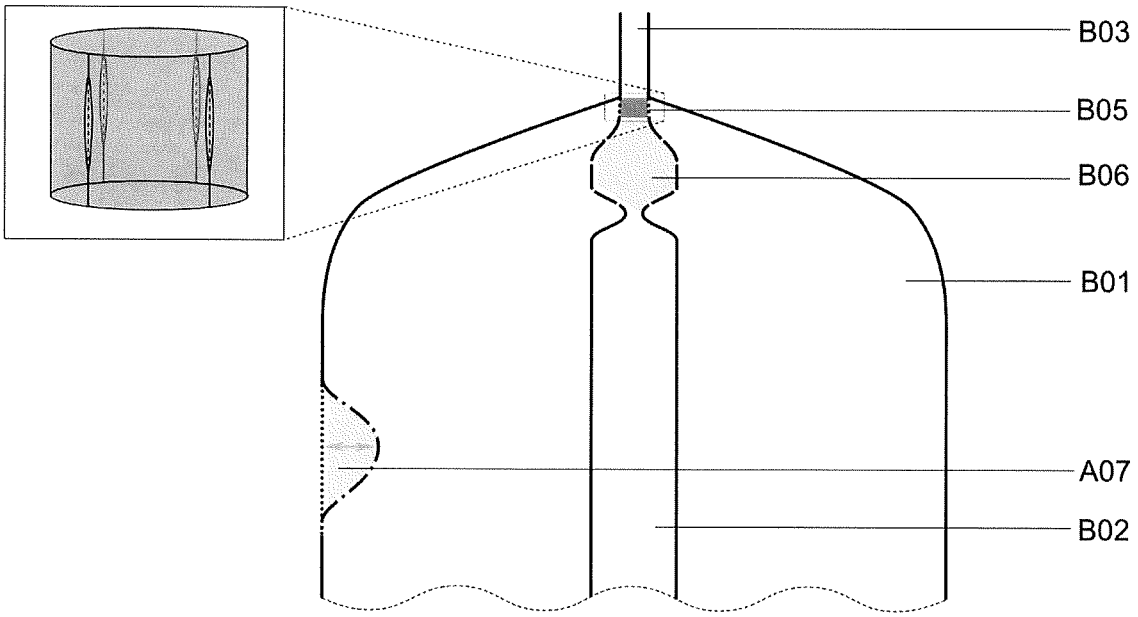
FIG. 4 schematically depicts the device of Example B, with the magnified portion illustrating a design of an example valve.

The device used for this experiment comprises a drinking vessel containing a screw closure. A tube is mounted into a screw cap to which a small container is attached. The tube and the container are fluidly connected (FIG. 2A). The small container contains two openings that are indicated by arrows. The cross section in FIG. 2B reveals that the container has an inner chamber and two flanking channels that communicate with the inner chamber and the openings highlighted in FIG. 2A, respectively. Prior to the assembly of the device, both the open vessel (the vessel being referred to below as compartment B) and the inner chamber of the small container (the inner chamber being referred to below as compartment A) receive the desired solution. Thereafter, the vessel is closed by means of the screw cap, which places the container inside the vessel. The fill volume of the open vessel is such that the openings of the small container are not flooded upon assembly of the device. A user will first drink the solution of compartment A and then the solution of compartment B when sucking from the tube that passes through the screw cap (FIG. 2A). In the actual devices built, compartment A is capable of holding 5 mL of liquid and compartment B in excess of 100 mL.

Three devices were used in the experiment. Compartments A and B of device no. 1 both received a sugared solution containing 10 wt. % sugar. Compartment A and B of device no. 2 both received a sugared solution containing 6 wt. % sugar. Compartment A of device no. 3 received 2.5 mL of a sugared solution containing 46 wt. % sugar and compartment B a solution that lacked sugar. The solutions in all compartments also comprised 1.5 wt. % of natural lemon juice. Hence, when drinking a sip of 23 g from each device the probands consumed the same amount of sugar out of devices nos. 2 and 3 but 67% more sugar out of device no. 1.

Each of 10 test subjects took one sip of about 23 g from each device and rated their sweetness on a scale from 1 (not or only marginally sweet) to 4 (very sweet). Each proband repeated this procedure once. Before the experiment, each proband trained with a device only filled with water to learn how to drink a volume of about 23 g.

The results revealed that the solutions from devices nos. 1 and 3 were rated to have a sweetness of 3.1±0.8 and 3.0±0.8, respectively. The solution of device no. 2 received a score of 1.7±0.7. Hence, the test subjects readily distinguished solutions containing 10% sugar (device no. 1) and solutions containing 6% sugar (device no. 2). When drinking from device no. 3, the probands received a small volume of highly sugared solution that was followed by a larger volume of unsweetened solution. The rankings they accorded to the solutions they had consumed from devices nos. 1 and 3 were essentially the same, even though the total amount of sugar they had received from device no. 3 was only 60 wt. % of the amount they had consumed from device no. 1. This clearly demonstrated the retention effect and indicated that this effect could be used to reduce sugar consumption without compromising taste sensation.

The present disclosure provides a device for reducing the consumption of flavoring agents from a beverage while maintaining the taste sensation associated with the consumption of a conventional flavored beverage and without resorting to an addition of a replacement supplement. The device houses, within a drinking container, two beverage compartments, one holding a normally flavored or strongly flavored beverage and the other a partially- or non-flavored beverage. The device is configured such that, when initiating a drinking event, a subject first receives a small volume (e.g., 0.1-15 mL) of the normally or strongly flavored beverage. This prompts a response of the taste receptors in the tongue, oral cavity and early parts of the digestive system. Ingestion of the flavored beverage can be passive when the device is tilted or it can require the subject to suck a mouthpiece, depending on the design of the device. Activation of the receptors conveys to the subject the agreeable taste sensation that it expects when drinking a flavored beverage. Owing to the above-described retention effect, this taste sensation is maintained for a certain period of time. During this period of time, the subject will not be able to recognize the difference between continuing drinking a strongly flavored beverage and drinking a partially- or non-flavored beverage. The device is capable of switching from the compartment holding the normally or strongly flavored beverage to the compartment holding the partially- or non-flavored beverage as soon as the subject has received the afore-mentioned small volume of normally or strongly flavored beverage and of switching back at the end of a drinking event. As the various example devices described further below demonstrate, there are numerous technical solutions that provide for this switching between the two compartments. A device of the present disclosure can comprise a mechanism that prevents the further ingestion of partially- or non-flavored beverage after a certain volume of partially- or non-flavored beverage has been consumed to preclude consumption when taste sensation has significantly declined, i.e., after the retention effect has waned. Also encompassed is a mechanism that prevents further ingestion of partially- or non-flavored beverage after a preset time has elapsed. The duration during which drinking of the partially- or non-flavored beverage is enabled is chosen based on the experimentally assessed average duration of the retention effect. The device can be configured for any larger desirable number of drinking events, i.e., for about 15-70 drinking events for a device that holds one liter (L) of beverage, and, more preferably, for about 20-60 drinking events.

The present disclosure also relates to devices that comprise two separate parts that are capable of being assembled or brought into communication by a subject. The first part of a device of this type can comprise a drinking container capable of being closed by a cap such as a bottle with a threaded neck. This drinking container is intended for receiving a partially- or non-flavored beverage. The second part can comprise an assembly that includes a cap with an inserted drinking tube, a reservoir for holding a normally or strongly flavored beverage and a mechanism that in the assembled device is capable repeatedly delivering to a subject first a volume of normally or strongly flavored beverage and immediately thereafter a similar or larger volume of a partially- or non-flavored beverage. Also encompassed are solutions in which the first part comprises a drinking container for holding a partially- or non-flavored beverage and the second part a drinking tube into which the latter mechanism and reservoir are integrated. In such a device, the two parts are brought together by a subject wishing to initiate a drinking event. The present disclosure also relates to devices in which a flavoring agent is stored as a solid that is dissolved in a partially- or non-flavored beverage during a drinking event to constitute a normally or strongly flavored beverage. In a very basic embodiment of such a device, the first part could be a drinking glass holding a partially- or non-flavored beverage and the second part a straw impregnated on its interior surface with a flavoring agent. A subject would immerse the straw in the beverage and then begin to drink through the straw. During the initial one or more sips, the subject would consume a normally or strongly flavored beverage resulting from the dissolution of the flavoring agent upon passage of the beverage. When continuing to drink, the subject would begin to receive partially- or non-flavored beverage.

It is a key feature of a device of the present disclosure that it requires a substantially lower amount of a flavoring agent for generating the same taste experience as a beverage in which the same flavoring agent is homogeneously distributed upon consumption of similar volumes of beverage.

The present invention, thus generally described, will be understood more readily by reference to the following examples, which are provided by way of illustration and are not intended to be limiting of the present invention.

EXAMPLES

The example devices may be configured to enable a single drinking event or multiple drinking events. Furthermore, they may be developed as one-way or reusable (refillable) devices. In the example devices, the flavoring agent is sugar (sucrose). It is understood that sugar can be substituted by any other flavoring agent. The explanatory figures (FIGS. 3-10) are not to scale.

Example A

The title device (FIG. 3) is comprised of a drinking container that has a wide neck portion to which is fitted a mouthpiece (A01). At the neck-proximal end of the mouthpiece is mounted a check valve (A08) that permits flow of liquid and air only in the direction of the arrow. The valve opens when a pressure differential is created by a drinking action. The check valve can be any suitable check valve, e.g., a ball check valve, a diaphragm check valve or other check valve known in the art. Inserted in the wide neck portion is a mechanism for modulating sugar concentration of the beverage. It consists of a rigid cylinder (A03) and a system of connected narrow paths (A04) that provide a fluid connection between the main compartment (A02) and the outside surface of cylinder (A03). The side wall of cylinder A03 is perforated and covered on its outer or inner surface by a semipermeable membrane (A05) that permits an exchange of sugar between the solution in cylinder (A03) and the solution in paths A04. Semipermeable membranes, commonly referred to as dialysis membranes, are well known in the art and are commercially available. (See, e.g., A. C. Yamashita, K. Sakurai, Updates in Haemodialysis—chapter 10: Dialysis Membranes—Pysiochemical Structures and Features, Vienna, Austria, IntechOpen, 2015.) Cylinder A03 is filled with a solution containing a high concentration of sugar. Main compartment A02 holds a sugar-free or weakly sugared solution. The walls of compartment A02 are rigid except for a sector (A07) that is made from an elastic material which material can expand inward into the compartment to compensate reduced pressure in the compartment. Moreover, a pressure control valve (A06) is mounted in the rigid portion of the compartment.

To drink from the device, the device is inverted which causes paths A04 to be filled with sugar-free or weakly sugared solution due to gravity and capillary action. After a short delay, the sugar concentration has risen in paths A04, and the device is ready for a drinking event. By sucking mouthpiece A01, a subject will trigger the opening of check valve A08, and solution begins to flow. The sugar-enriched solution from paths A04 will be ingested first (e.g. 0.1-15 mL). Thereafter, sugar-free or weakly sugared solution that has been flowing rapidly past cylinder A03 and, therefore, has not been enriched with sugar will be consumed. The subject will stop drinking when the material in sector A07 has reached the limit of its elasticity and cannot further alleviate negative pressure buildup in the device. Sector A07 is configured such that the (continuous) drinking event is stopped prior to the waning of the retention effect (to avoid the sensation of unsweetened solution). Pressure control valve A06 will cause a slow equilibration of pressure in the device, readying the device for the next drinking event (with paths A04 already containing sugar-enriched solution).

Example B

The title device (FIG. 4) is comprised of a drinking container that has a wide neck portion to which is fitted a mouthpiece (B03). The drinking container comprises two compartments. A main compartment (B01) contains a partially sweetened or unsweetened solution. The second compartment (B02/B06) is situated centrically in the drinking device and holds a 3 to 50 times or, more preferably, a 6 to 20 times smaller volume of solution than main compartment B01. Compartment B02/B06 contains a sugar-enriched solution. In the user-distal end of the mouthpiece is mounted a pressure sensitive valve (B05) that when actuated opens a path between compartment B01 and mouthpiece B03, permitting the exchange of liquid and air. The valve is actuated, i.e., opens, when a pressure differential is created by the drinking action. A possible design of such a valve comprising four slits is shown in the magnified portion of FIG. 4. The slits open when negative pressure builds up in mouthpiece B03. Sub-compartment B06 is delimited by elastic material, whereas sub-compartment B02 is delimited by rigid walls. The walls of compartment B01 are rigid except for a sector A07 that is made from an elastic material which material can expand inward into the compartment to compensate reduced pressure in the compartment.

To drink from the device, a subject begins sucking mouthpiece B03, ingesting the sugar-enriched solution contained in sub-compartment B06 (e.g. 0.5-15 mL). Sub-compartment B06 collapses, and further sucking motion results in the opening of valve B05. The subject will then begin drinking partially sweetened or non-sweetened solution from main compartment B01. Negative pressure building in the device is compensated by the inward flexing of section A07. The subject will be forced to stop drinking when the material in sector A07 has reached the limit of its elasticity and is incapable of further alleviating negative pressure buildup in the device. Sector A07 is configured such that the drinking event is terminated prior to the waning of the retention effect (to avoid the sensation of unsweetened beverage). When the subject stops sucking mouthpiece B03, i.e., disengages from the mouthpiece, ambient pressure will re-establish itself in the device. Air flows from the mouthpiece into compartment B02/B06 as well as through valve B05 into compartment B01. Compartment B06 will re-expand to its original bulbous shape.

In another embodiment of the example device, valve B05 may be omitted. When drinking from this device, a subject would initially ingest both sugar-enriched solution from sub-compartment B06 and partially sweetened or non-sweetened solution from main compartment B01. The sweetness of the solution in compartment B02/B06 would be adjusted such that a retention effect is prompted at the beginning of the drinking event. As sub-compartment B06 is emptied, the subject would increasingly consume partially sweetened or non-sweetened solution from compartment B01.

Example C

Figure 5:
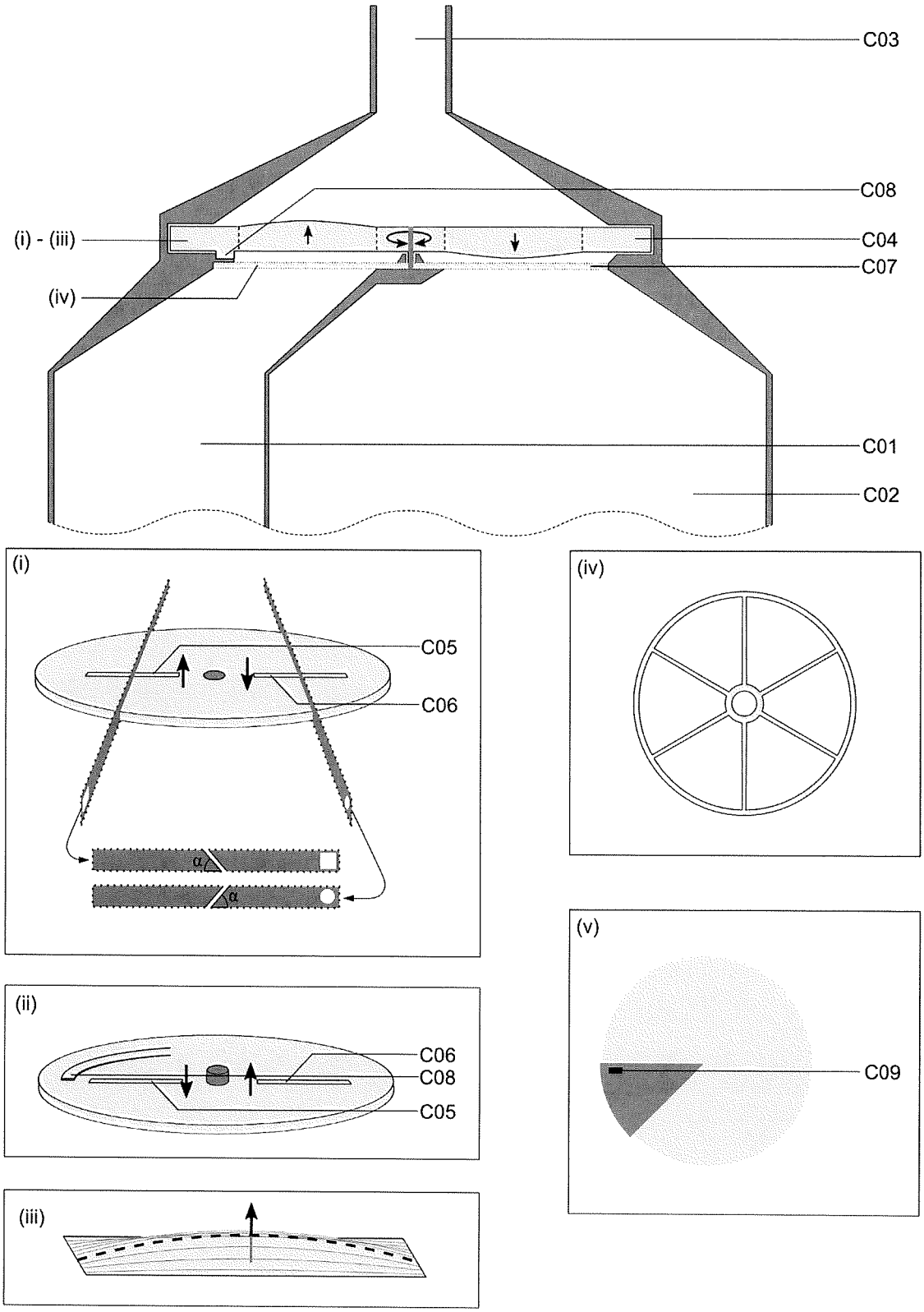
FIG. 5 provides to a schematic representation of the device of Example C. Illustrations (i)-(v) depict various aspects of the device. Illustration (i) depicts the upper side of disc C04 and presents two cross sections, and illustration (ii) shows the lower side of disc C04.
Figure 6:
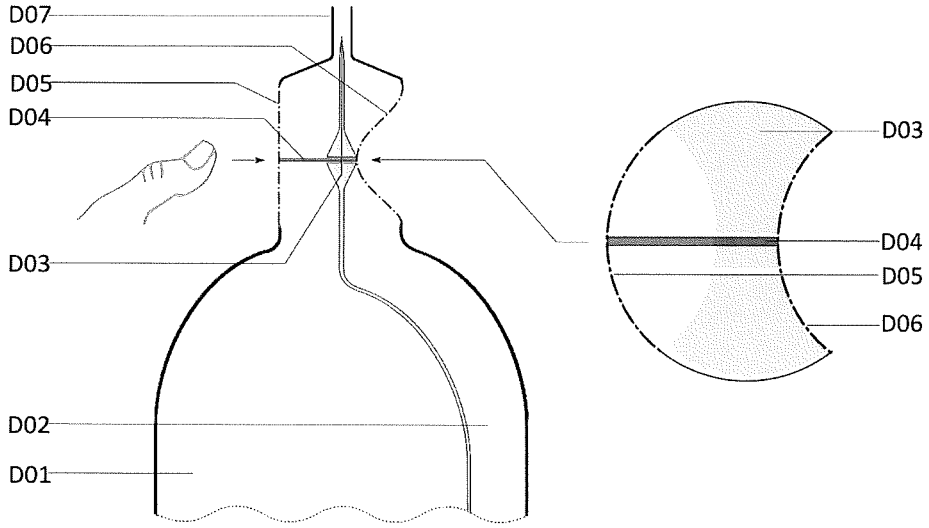
FIG. 6 depicts schematic section and top views concerning the device of Example D. The device is shown in a relaxed state (top half) and in a non-relaxed state (bottom half).
Figure 6:
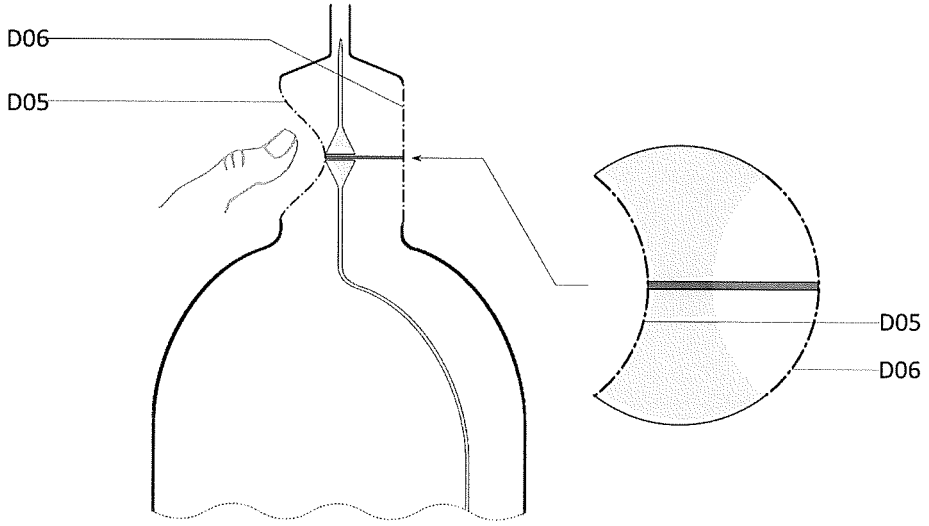

The two solutions in the drinking container (FIG. 5) are stored in compartments (C01) and (C02), respectively. Main compartment C02 holds the partially- or non-sweetened solution. Compartment C01 holds the strongly sweetened solution and has a fillable volume that is 3 to 50 times or, more preferably, 6 to 20 times smaller than that of main compartment (C02). The mechanism that controls access to compartments C01 and C02 is located between the compartments and mouthpiece C03. It consists of disc C04 that is axially mounted on disc C07, which disc is affixed to the interior wall of the drinking containing as shown in FIG. 5. Disc C07 is perforated to allow liquid to pass unimpeded as is illustrated in part (iv). Disc C04 is capable of pivoting on its central axis counterclockwise from arrest feature C08 and clockwise back to the arrest feature. Disc C04 contains elongated openings C05 and C06, which openings are slanted (at an angle ($\alpha$)) as illustrated in part (i)). Liquid and air essentially only pass disc C04 through openings C05 and C06. Directionality of flow (as indicated by the arrows in parts (i) and (ii))) is provided by valves mounted on the upper and lower sides of the openings, respectively. An exemplary valve design is shown in part (iii). In its resting position (disc C04 at the arrest), opening C05 is positioned above compartment C01. This position is labeled as C09 in part (v). The dark-shaded area depicts the location of compartment C01, and the lightly shaded area that of compartment C02. It is noted that surface area ratio C01:C02 was arbitrarily chosen to be 1:8 in this example.

When sucking the mouthpiece (C03), a subject first drinks strongly sweetened solution that flows to the mouthpiece through opening C05 (e.g. 0.5-15 mL). This flow causes disc C04 to pivot counterclockwise. The motion causes C05 to become positioned over compartment C02. The subject now consumes partially or non-sweetened solution. As soon as the retention effect wanes, the opening C05 has crossed the lightly-shaded area (see part (v)) and is again positioned above compartment C01. Thus, sweetened solution reaches again the mouthpiece which makes continuous drinking possible. When the subject stops sucking the mouthpiece and disengages from the drinking device, air flows back into the device from the mouthpiece and passes through opening C06 to equalize pressure in the compartments. The flow of air through opening C06 causes disc C04 to pivot back until it reaches its resting position. The device is now ready for a further drinking event.

Example D

The title device allows a subject to itself control a drinking event. The device is depicted in a relaxed state in the top half of FIG. 6 and a non-relaxed state in the bottom half of FIG. 6. A drinking container made from rigid material comprises compartments D01 and D02, both of which extend from the bottom of the drinking container to a position between mouthpiece D07 and switching mechanism D04 that is located in the neck of the drinking container. Main compartment D01 holds the partially- or non-sweetened solution. Compartment D02 holds the strongly sweetened solution and has a fillable volume that is 3 to 50 times or, more preferably, 6 to 20 times smaller than that of main compartment D01. The drinking container has a neck portion that is made from a flexible material. The switching mechanism consists of rod D04 that penetrates wall D03 separating compartments D01 and D02 and abuts walls D05 and D06 of the neck portion of the device. The neck portion is made from deformable material. In the relaxed state, wall D06 is caved inwards and abuts wall D03 (see also the top view in the top half of FIG. 6)). In the non-relaxed state, wall D05 is forced inwards by pressure applied by the subject (at a marked position overlying the point of contact of rod D04). The rod is displaced and forces wall D06 outwards so that it no longer contacts wall D03 (see also the top view in the bottom half of FIG. 6)).

To drink from the device, the subject applies pressure to wall D05 at the marked position (indicated by an arrow in FIG. 6) to displace rod D04 inward. The subject then inverts the bottle and begins to drink from compartment D02 that contains the strongly sweetened solution. As soon as the subject releases pressure on the neck, it will begin to drink from compartment D01 that contains the partially- or non-sweetened solution.

Example E

Figure 7:
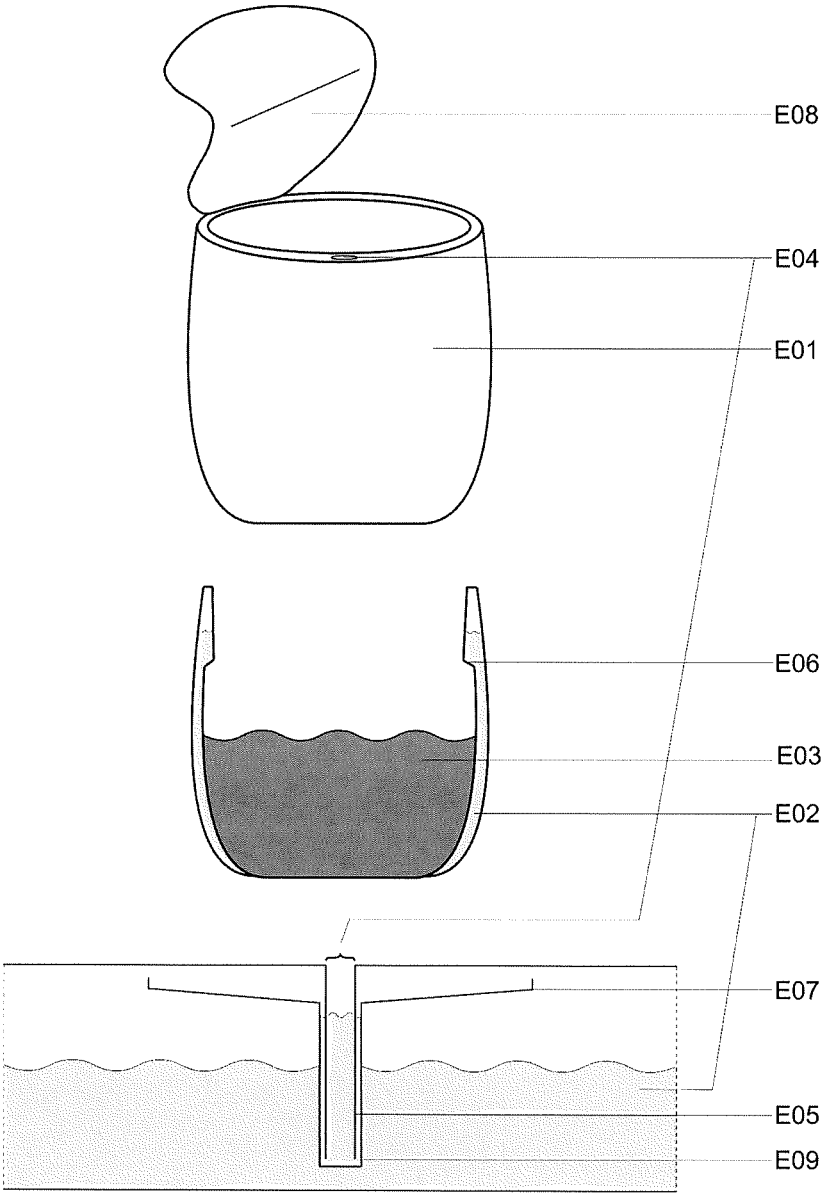
FIG. 7 shows schematic side and section views of the device of Example E. At the bottom is shown a magnified section view of the wall compartment.
Figure 8:
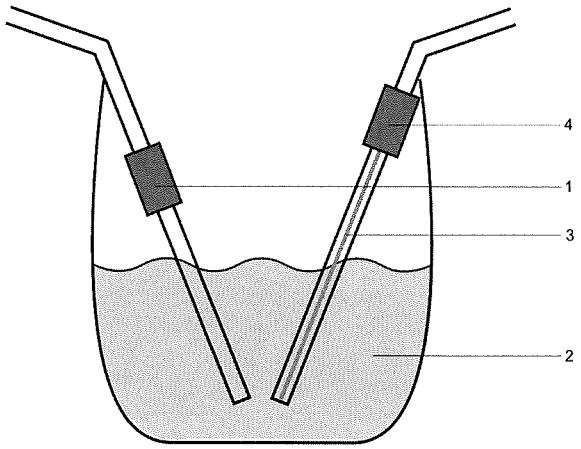
FIG. 8 relates to schematic representations of two-part devices comprising a drinking glass or vessel and a drinking tube providing a flavoring agent.
Figure 9:
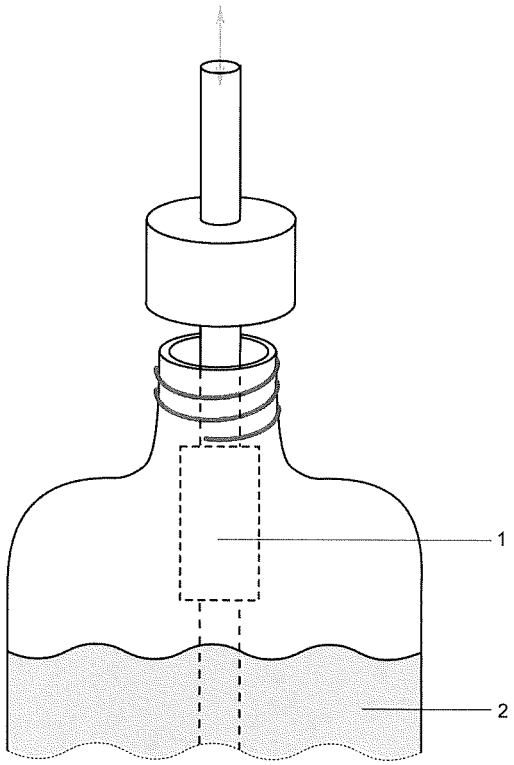
FIG. 9 depicts a two-part device comprising a drinking container having a threaded neck holding an unflavored or weakly flavored beverage and an assembly consisting of a screw cap containing an inserted drinking tube to which is mounted a housing that contains a reservoir for a flavored beverage and a fluid control mechanism.

The title device is depicted in FIG. 7. It comprises a double-walled drinking container (E01) made from rigid material that has a main compartment (E03) for holding a partially- or non-sweetened solution and a wall compartment (E02) for holding a strongly sweetened solution. The drinking container may further contain an openable lid (E08). The main compartment has an indentation near the rim (E06) whose purpose it is to allow a subject to drink from compartment E02 at a lower tilt angle of the device than from main compartment E03. The wall compartment contains an inserted inner tubular element (E05) that is open at both ends, forming opening E04 on the rim of the drinking container. The inner tubular element E05 is surrounded by an outer tubular element (E09) that is closed at the bottom end and is connected with collection pan E07 at the top end.

Prior to the first use of the device, both main and wall compartment contain the respective solutions, and the space in the inner tubular element is prefilled with a volume (e.g., 0.1-15 mL) of strongly sweetened solution adequate for a first sip. To initiate the first drinking event, the subject tilts the device slightly to drink strongly sweetened solution from opening E04. As it tilts the device further, the subject begins to drink partially- or non-sweetened solution from compartment E03. At this higher tilt angle, the collection pan fills with a volume of strongly sweetened solution from wall compartment E02 that will be adequate for the first sip consumed during the second drinking event. After drinking, i.e., at the end of the first drinking event, the user rests the device in an upright position, in which position the solution in the collection pan refills the inner tubular element E05. The device is then ready for the second drinking event.

In the afore-described examples, drinking container and mechanism for switching between delivery of a highly flavored solution and an unflavored or weakly flavored solution are integrated in a single device. The drinking container can also be separated from the remaining part of the device, the latter referred to as "core device". In a simple device, a straw or drinking tube contains an integrated core device that is a container (depicted as element 1 in the left straw in FIG. 8) that holds an adequate amount of a flavoring agent, e.g., sugar. When the straw is immersed in unflavored or weakly flavored solution (2), a subject sucking the straw will first consume a volume of solution that has been flavored during the course of its passage through container (1). Thereafter, when the container no longer contains flavoring agent, the user will consume unflavored or weekly flavored solution (2). In more complex solutions that can be configured for one or more drinking events, the core device includes a container holding a highly flavored solution and a switching mechanism that alternatively enables consumption of a highly flavored solution and an unflavored or weakly flavored solution. The straw/drinking tube on the right in FIG. 8 incorporates such a core device that comprises a reservoir for a highly flavored solution contained within the straw (3) and an integrated switching mechanism (4). As shown schematically in FIG. 9, the present disclosure also encompasses the possibility that a core mechanism (1) that is integrated in a drinking tube is combined with a closure, e.g., a screw cap. A subject may itself combine the latter assembly with a conventional drinking container, e.g., a bottle containing an appropriately threaded neck, holding an unflavored or weakly flavored solution (2).

Example F

Figure 10:
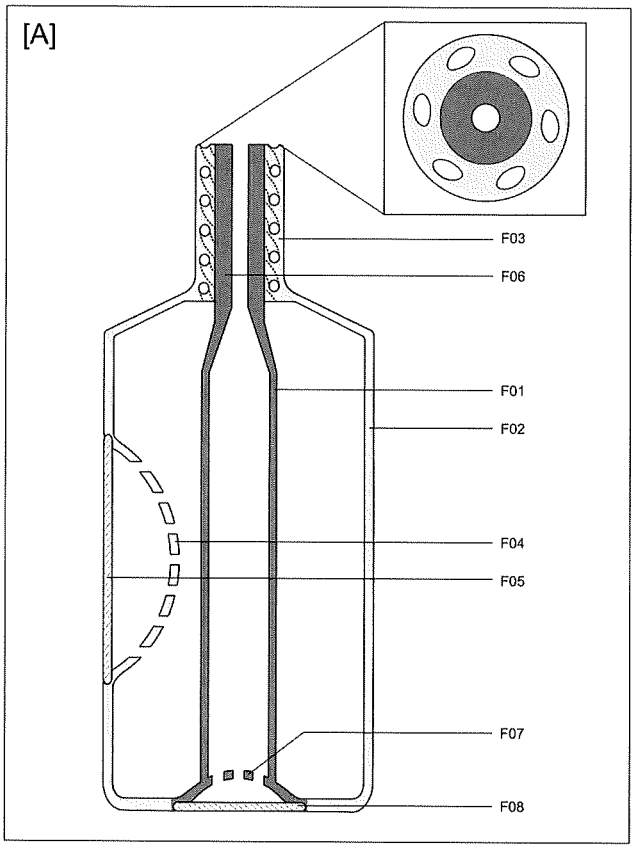
FIG. 10 depicts a device comprising a first container for holding a flavored beverage, which container is inserted in a second container for holding a less flavored or unflavored beverage. A fully assembled device (unfilled) is shown in A. A device of the same type that may be assembled by a user is shown in B. A similar device assembled from a commercially available drinking bottle that serves as a second container and a kit comprising a first container is shown in C.
Figure 10:
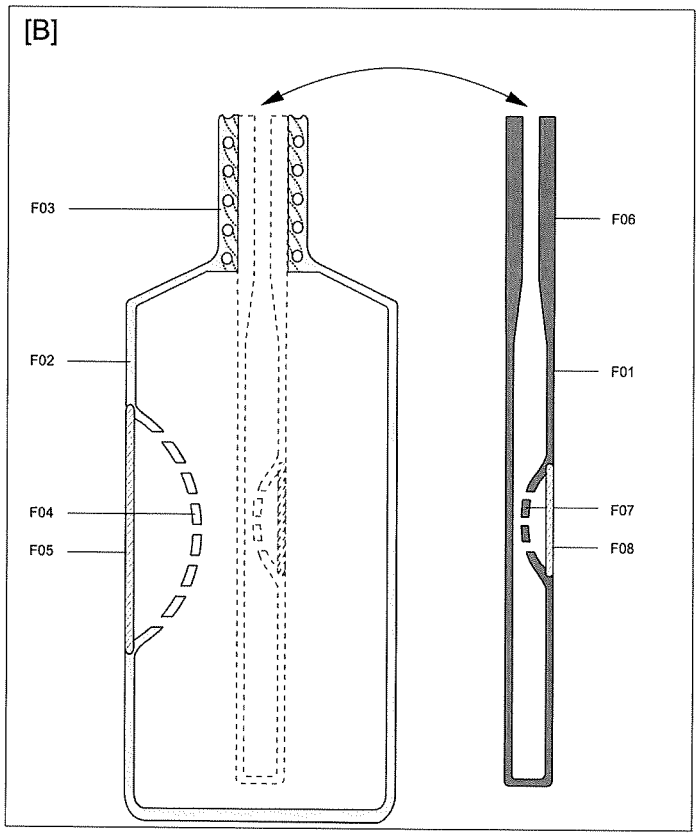
Figure 10:
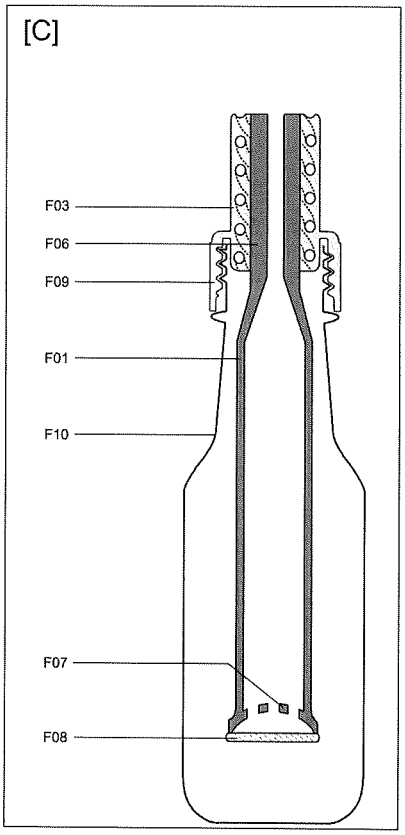

The title device is depicted in FIG. 10 A (vertical cross-section). The device comprises an inelastic inner container (F01) that holds the strongly sweetened solution (or beverage) and an inelastic outer container (F02) that holds the partially sweetened or unsweetened solution (or beverage). The two containers do not fluidly communicate with one another.

In the embodiment depicted in FIG. 10 A, the outer container has a round horizontal cross-section. At its upper end, it comprises a neck portion (F03). Contained in the neck portion are multiple conduits each of which follows a helical path through the neck portion. Each conduit communicates with the interior space of the outer container at its lower end and with an orifice at its upper end. The number of conduits, the inner diameters of the conduits and the angle of the helical paths of the conduits may vary in different embodiments. The wall of the container comprises an indented portion (F04) that comprises one or more perforations that allow for the passage of liquid. The base of the indentation is sealedly covered by an elastic membrane (F05) that is impermeable to gases and liquids. To prevent the membrane from bulging outward, a perforated (or gas-permeable), rigid wall part may be mounted that covers the membrane (not shown in the figure). This wall part must be mounted in such a way that it does not prevent the membrane from bulging inward when the outer container is under negative pressure, which is generated when a subject sucks from the mouthpiece (neck). Under rising negative pressure, the membrane is increasingly deformed until it finally lies against the indented portion of the container. The indentation is configured such that the space between the indented portion and the unstressed or relaxed membrane corresponds to the maximal volume of partially sweetened or unsweetened solution that a subject can drink in a single drinking event before the "retention effect" wanes.

In the embodiment depicted in FIG. 10 A, the inner container is centrally arranged and has a round horizontal cross-section. At its upper end, the inner container comprises a neck portion (F06) that ends in an orifice. The neck portion of the inner container fits snugly and sealedly into the interior space of the neck portion of the outer container. The lower end of the inner container is dome-shaped, the domed portion (F07) containing one or more perforations. The perforations in the domed portion allow for the passage of liquid. When the device is in an upright position, the space under the dome holds a volume of strongly sweetened solution that is sufficient for generating an initial sensation of sweetness in the mouth of a subject (to allow for the exploitation of the "retention effect"). The bottom of the inner container comprises an elastic membrane (F08) whose perimeter is sealedly attached to the domed portion at its base. The membrane is liquid- and gas-impermeable. To prevent the membrane from sagging, a perforated (gas-permeable), rigid (inelastic) support may be affixed to the bottom of the device (not shown in the figure). This affixture is such that the inward deformation of the membrane is not impeded when the inner container experiences negative pressure. In other embodiments, there may be an indentation in the wall of the inner container rather than a dome at the bottom (see, e.g., the inner container of FIG. 10 B). In these embodiments, the membrane is affixed to the base of the indentation, and the space defined by the indented portion of the wall and the membrane corresponds to the volume of strongly sweetened solution that is required for generating a sensation of sweetness in the mouth of a subject.

The insert shows a top view of the mouthpiece area (ends of the necks of the containers) with its orifices. The orifice in the center communicates with the inner container. The outer orifices communicate with the outer container.

When a subject initiates a drinking event, it takes the mouthpiece in its mouth and tilts the device. When the subject sucks from the mouthpiece, the strongly sweetened solution flows out of the straight neck of the inner container and immediately comes into contact with the receptors that are mainly located on the tongue of the subject. The amount of liquid that can be sucked from the inner container is limited to the volume under the dome. Because of the winding arrangement of the conduits in the neck of the outer container, the partially sweetened or unsweetened solution flows into the mouth of the subject in a time-delayed fashion. Also, because of the angled paths of the conduits, the direct targeting of the receptors on the tongue is minimized. When, because of the negative pressure building up in the device owing to the sucking movement, the membrane covering the indentation in the outer container is deformed inward and comes to lie against the indented portion of the container, no additional volume of solution can be sucked from the outer container. The subject then swallows the liquid in its mouth, terminating the drinking event. The swallowing movement releases the negative pressure in the device, and the membranes return to their relaxed state. The device is now ready for a further drinking event. This further drinking event can be initiated by the subject without disengaging from the device.

In the embodiment shown in FIG. 10 B, an outer container (that may be used repeatedly) and an inner container are provided separately and are combined by a subject. The outer container is filled (to an indicated level) by the subject with a partially sweetened or unsweetened solution of its choice (e.g., tap water). The subject also inserts the inner container into the outer container, whereby the complete device is assembled. Preferably, the inner container will be provided prefilled with a strongly sweetened solution (single use). In a somewhat different embodiment, the inner container (that may be used repeatedly) is provided empty and can be filled by the subject with a strongly sweetened solution of its choice. It is noted that, in different embodiments, the "dosing mechanism" comprising elements F07 and F08 may be incorporated in the outer container rather than the inner container.

To connect the inner container and outer container (at the respective necks), several mechanisms can be employed. The neck of the inner container can be held within the neck of the outer container based on friction. Another possibility is the use of a click mechanism, whereby the neck portion of the inner container becomes locked into the neck portion of the outer container through a twisting or pushing movement. A further alternative would the use of a thread-based mechanism.

In yet another embodiment, shown in FIG. 10 C, the device is assembled by combining a commercially available drinking bottle that is elastically deformable (e.g., a disposable PET bottle) or a commercially available drinking bottle that contains a regulated valve (F10) and a kit that provides the other elements of the device. In this case, the commercially available drinking bottle serves as the outer container. In a typical embodiment, the commercially available drinking bottle will have a threaded neck. The kit will comprise the inner container (F01), the neck portion of the outer container (F03) and a threaded adapter (F09) that will fit the threaded neck of the commercially available drinking bottle. The inner container of the kit may be pre-filled with a strongly sweetened solution. In this case, the kit will be single-use. Alternatively, the inner container of the kit will be provided empty of liquid. The filling of the container will be left to the user. In this case, the kit may be used repeatedly.

Example G

Figure 11:
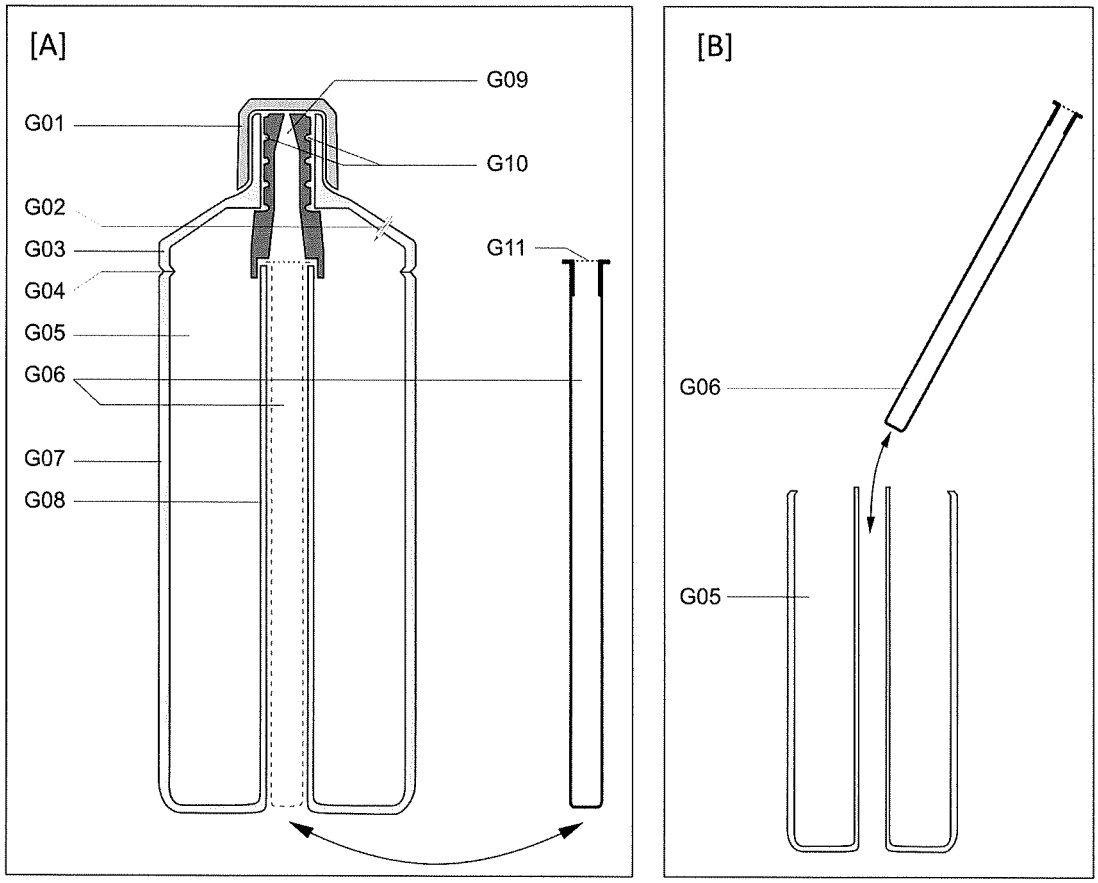
FIG. 11 depicts in A another device comprising a first container that is to hold a flavored beverage, which first container is inserted in a second container that is to hold a less flavored or unflavored beverage. The insertion of the first container into the lower part of the second container is shown in B.

The title device is depicted in FIGS. 11A and B (vertical cross-sections). The device uses a mechanism for releasing first a desired volume of a flavored beverage and thereafter a desired volume of a less flavored or unflavored beverage resembling that employed by the device shown in FIG. 10. The device comprises an outer container (G05) (second container) that is to hold the less flavored or unflavored beverage and an inner container (G06) (first container) that is to hold the flavored beverage. The rigid outer container (G05) can consist of two parts that are connected in a liquid-tight fashion (e.g., by a threaded coupling) (G04). The lower part has a doughnut-shaped horizontal cross-section and contains an outer (G07) and an inner wall (G08). It serves to hold the less flavored or unflavored beverage. The upper part (G03) that connects with the outer wall (G07) of the lower part has a round horizontal cross-section that tapers off into a neck portion the upper end of which serves as a mouthpiece. Below the neck is inserted a valve (e.g., an umbrella valve) (G02) in the wall, which valve serves to control pressure in the outer container (G05). In the assembled outer container, the neck portion incorporates outer (G10) and inner conduits (G09). The outer conduits (1-10) (G10) describe helical paths and connect the inside of the outer container (G05) with orifices in the mouthpiece. The single inner conduit (G09) follows a straight path and connects a further orifice in the mouthpiece with the inner space of the outer container into which inner space the inner container (G06) is inserted that serves to hold the flavored beverage. At the neck-distant end of the inner conduit (G09) is mounted a mechanism that serves to accept the inner container (G06) and forms a liquid-tight connection with the inner container. Except for the end portion that is connected with the inner conduit (G09), the inner container (G06) is made from deformable material. Prior to the assembly of outer and inner containers, the end of the inner container (G06) that is to communicate with the inner conduit (G09) is covered by a film (G11). This film (G11) can be manually removed prior to assembly of outer and inner containers or, if the device is adapted for this, is pierced upon assembly. The neck portion may be covered by a lid (G01) to prevent spills.

When a subject initiates a drinking event, it takes the mouthpiece in its mouth and tilts the device. When the subject sucks from the mouthpiece, a volume of flavored beverage flows out of the straight conduit (G09) of the inner container (G06) and immediately comes into contact with the receptors that are mainly located on the tongue of the subject. Because of the winding arrangement of the outer conduits (G10), the less flavored or unflavored beverage flows into the mouth of the subject in a time-delayed fashion. Also, because of the angled paths of the conduits (G10), the direct targeting of the receptors on the tongue is minimized. The subject then swallows the liquid in its mouth, terminating the drinking event. The device is instantaneously ready for a further drinking event. This further drinking event can be initiated by the subject without disengaging from the device.

Recitation of ranges of values herein are merely intended to serve as a shorthand method of referring individually to each separate value falling within the range, unless otherwise indicated herein, and each separate value is incorporated into the specification as if it were individually recited herein.

The terms "a", "an", "the" and similar terms are to be construed to cover both the singular and the plural unless otherwise indicated or clearly contradicted by the context.

The description herein of any aspect or embodiment of the invention using terms such as reference to an element or elements is intended to provide support for a similar aspect or embodiment of the invention that "consists of," "consists essentially of" or "substantially comprises" that particular element or elements, unless otherwise stated or clearly contradicted by context (e.g., a composition described herein as comprising a particular element should be understood as also describing a composition consisting of that element, unless otherwise stated or clearly contradicted by context).

This invention includes all modifications and equivalents of the subject matter recited in the aspects or claims presented herein to the maximum extent permitted by applicable law.

All references cited in this application, including publications, patents and patent applications, shall be considered as having been incorporated in their entirety.

The invention claimed is:

1. A device for the controlled sequential release of a flavored beverage and a less flavored or unflavored beverage, the device consisting of a drinking vessel comprising (a) a first compartment within the drinking vessel which first compartment holds the flavored beverage or a flavoring agent for reconstituting the flavored beverage, wherein the first compartment is a first container having a first neck portion, (b) a second compartment within the drinking vessel which second compartment holds the less flavored or unflavored beverage, wherein the second compartment is a second container having a second neck portion, and wherein the first container is contained in the second container and the first neck portion is sealedly inserted into the second neck portion, whereby the first and second neck portions are forming a mouthpiece from which a subject can drink; and (c) a mechanism that releases first a defined volume of the flavored beverage and thereafter a volume of the less flavored or unflavored beverage when a subject is drinking from the drinking vessel, wherein when the subject initiating a drinking event takes the mouthpiece in its mouth, tilts the device, and sucks from the mouthpiece, a volume of flavored beverage flows out of the straight or not-winding conduit) of the inner container and immediately comes into contact with the receptors that are mainly located on the tongue of the subject and, because of a winding arrangement of the outer container's conduits, the less flavored or unflavored beverage flows into the mouth of the subject in a time-delayed fashion.

2. The device of claim 1, wherein the mechanism further limits the volume of the less flavored or unflavored beverage that the subject can consume during a single drinking event.

3. The device of claim 2, wherein the first compartment is a first container having a first neck portion comprising a straight conduit that fluidly connects the interior space of the container with an orifice and a first perforated indentation in the wall or the bottom, which indentation is sealedly covered at its base by a flexible gas- and liquid-impermeable membrane, the second compartment is a second container having a second neck portion comprising one or more conduits that helically wind through the second neck portion and fluidly connect the interior space of the second container with one or more orifices and a second perforated indentation in the wall or the bottom, which indentation is sealedly covered at its base by a flexible gas- and liquid-impermeable membrane, and the first container is contained in the second container and the first neck portion is sealedly inserted into the second neck portion, the first and second neck portions forming a mouthpiece from which a subject can drink.

4. The device of claim 2, wherein the first compartment is a first container having a stiff upper portion and a flexible lower portion and the second compartment is a rigid second container having a doughnut-shaped horizontal cross-section defining an inner space into which the first container is inserted, a neck portion comprising one or more outer conduits and an inner conduit, and a valve for pressure regulation inserted in the wall of the container, wherein the outer conduits wind helically through the neck portion and fluidly connect the interior space of the second container with one or more orifices at the exposed end of the neck portion and wherein the inner conduit is straight and fluidly connects the interior space of the first container with a further orifice at the exposed end of the neck portion.

5. The device of claim 1, wherein the mechanism is capable of effecting said sequential beverage release during multiple drinking events.

* * * * *